US008322812B2

(12) United States Patent
Ren et al.

(10) Patent No.: US 8,322,812 B2
(45) Date of Patent: Dec. 4, 2012

(54) ALTERNATE IMAGING ORDER FOR IMPROVED DUPLEX THROUGHPUT IN A CONTINUOUS PRINT TRANSFER PRINTER

(75) Inventors: Zhikui Ren, Portland, OR (US); Daniel Clark Park, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 193 days.

(21) Appl. No.: 12/972,577

(22) Filed: Dec. 20, 2010

(65) Prior Publication Data

US 2012/0154471 A1 Jun. 21, 2012

(51) Int. Cl.
*B41J 29/38* (2006.01)

(52) U.S. Cl. ..... 347/16; 347/101; 347/104; 271/186

(58) Field of Classification Search ..... 347/16, 347/20, 44, 47, 49, 56, 61–65, 67, 84–87, 347/101, 104; 271/176, 65, 291, 270, 182, 271/186

See application file for complete search history.

(56) References Cited

U.S. PATENT DOCUMENTS

| | | | | |
|---|---|---|---|---|
| 4,935,786 | A | 6/1990 | Veeder | |
| 6,032,004 | A | 2/2000 | Mirabella, Jr. et al. | |
| 6,199,858 | B1 | 3/2001 | Wyer | |
| 6,275,676 | B1 | 8/2001 | Ushio | |
| 6,393,252 | B1 | 5/2002 | Yamagishi | |
| 6,644,652 | B1 * | 11/2003 | Walsh et al. | 271/186 |
| 7,021,739 | B2 | 4/2006 | Burke et al. | |

* cited by examiner

*Primary Examiner* — Juanita D Jackson
(74) *Attorney, Agent, or Firm* — Gibb & Riley, LLC

(57) ABSTRACT

A method/printer prints images on an "A" side of a first sheet of media and on an "A" side of a second sheet of media in a single full transfer rotation of a drum. The method then prints images on the B side of the first sheet and on an A side of a third sheet in a single full transfer rotation of the drum. Similarly, the method prints images on the B side of the second sheet and on an A side of a fourth sheet in a single full transfer rotation of the drum. This method then prints images on the B side of the third sheet and the B side of the fourth sheet in a single full transfer rotation of the drum.

20 Claims, 15 Drawing Sheets

IMAGE AND SIDE ASSOCIATION REFERENCE

| SHEET | IMAGE SIDE A | IMAGE SIDE B |
|---|---|---|
| 1 | 1 | 2 |
| 2 | 3 | 4 |
| 3 | 5 | 6 |
| 4 | 7 | 8 |
| 5 | 9 | 10 |

FIG. 21A

5 SHEET PRINT SEQUENCE WITH A-B IMAGE PAIRS

| SHEET | IMAGES | SIDES |
|---|---|---|
| 1 & 2 | 1 & 3 | A & A |
| 1 & 3 | 2 & 5 | B & A |
| 2 & 4 | 4 & 7 | B & A |
| 3 & 5 | 6 & 9 | B & A |
| 4 & 5 | 8 & 10 | B & B |

FIG. 21B

ALTERNATE 5 SHEET PRINT SEQUENCE WITH A-B IMAGE PAIRS

| SHEET | IMAGES* | SIDES | |
|---|---|---|---|
| 5 & 4 | 10 & 8 | A & A** | |
| 5 & 3 | 9 & 6 | B & A | 5 OUT, A SIDE UP |
| 4 & 2 | 7 & 4 | B & A | 4 OUT, A SIDE UP |
| 3 & 1 | 2 & 3 | B & A | 3 OUT, A SIDE UP |
| 2 & 1 | 3 & 1 | B & B | 2 & 1 OUT, A SIDE UP |

*AS WOULD BE REFERENCED BY PRINT JOB PAGE NUMBER
**FIRST DUPLEX SIDE TO BE IMAGED IS OUTPUT IMAGE SIDE UP

FIG. 21C

ALTERNATE IMAGING ORDER FOR IMPROVED DUPLEX THROUGHPUT IN A CONTINUOUS PRINT TRANSFER PRINTER

BACKGROUND

Embodiments herein generally relate to printing devices and more particularly to a printing device that modifies image creation order within a duplexing operation.

Competitive pressures demand the fastest possible printing speeds, while at the same time, prices must be held or lowered. Cost effective method and hardware solutions have been implemented in past products. The need for further improvement is always present, although elusive.

One advance included in some modern offset imaging devices, such as printers, MFPs, all-in-ones and the like, may be referred to as a multi-image duplexing printer capable of concurrently creating (jetting) two or more images or pages. With a multi-image duplexing printer, multiple images jetted onto an offset image receiving surface can be transferred to multiple sheets of media in a single transfer cycle. For example, marking material or ink, such as solid ink in a molten state, is jetted onto the image receiving surface, hereafter generally referred to as a drum, and each transfer rotation of the drum can transfer the multiple images to at least two sheets of media as the sheets pass through a transfix nip. Transfix is a term used to refer to image transfer to media from the offset image receiving surface by employing heat and/or pressure to fuse or fix the image to the media as the media and image pass through a transfer zone or nip. Transfer roller, pressure roller and transfix roller as used herein have the same meaning. Image refers to text and/or graphics created with an ink or marking material that is applied to one side of a media sheet. The terms media and paper may be used interchangeably and either term is intended to apply to any type of printable material. The surface receiving the jetted ink image prior to transfer to media is herein referred to as a drum or image receiving surface. The term drum herein encompasses any image receiving configuration with or without a surface coating, including a drum, band, belt or platen.

Conventional printing systems often provide the benefit of reduced paper consumption by enabling duplex printing (images on both sides of a sheet of media). Such duplexing operations are often accomplished by printing on one side of a sheet of media and then, rather than outputting the sheet from the printing device, directing the sheet of media through a duplex path. The duplex path reverses the orientation of the sheet of media with respect to the side being imaged (flips the sheet) and then reroutes the sheet through the imaging path to allow image transfer to the second side of the sheet. One issue associated with such duplexing operations is the time delay that occurs when the sheets are passed through the duplexing path.

SUMMARY

One exemplary two-up, three sheet embodiment herein is a method that jets the "A" image for a first sheet of media and an "A" side for a second sheet of media in a single imaging cycle. The cycle for jetting or imaging on the receiving surface may require multiple passes or drum revolutions. After jetting the images, they are transferred to two sheets of media within one drum revolution. This transfer process continues for the subsequent sequence. In order to simplify the explanation, each sheet of media will be considered to have one first or "A" side and one second or "B" side. Further, to simplify this example, duplex printing is performed on only three or four sheets; however, as would be understood by those ordinarily skilled in the art, the process could be used for any number of sheets.

The method then jets an image for the B side of the first sheet and for an A side of a third sheet in a single imaging cycle. In the next imaging sequence, the image for a B side of the second sheet and a B side of the third sheet are imaged. Prints are created by transferring (transfixing) the images to media as each imaging cycle is completed.

An exemplary four sheet method concurrently prints the "A" side image of a first sheet of media and the "A" side image of a second sheet of media. The method then prints the B side of the first sheet and the A side of a third sheet. Similarly, the method prints the B side of the second sheet and the A side of a fourth sheet followed by imaging the B side of the third sheet and the B side of the fourth sheet.

A printing device embodiment herein includes a media sheet supply, a paper path positioned to transport the media sheets, a release surface or drum positioned to receive the media sheets from the paper path, and an ink jet print head positioned to jet the ink to form an image on the release surface of the drum. A processor is operatively connected to (directly or indirectly) the paper path, the drum and the printhead.

The processor controls the various operations involved in printing, for example, drum motion and printhead imaging for the A side image of a first sheet and the A side of a second sheet then the media path and transfix roller to transfer the images to the "A" side of a first and a second media sheet. The processor similarly controls printing operations to create the B side of the first sheet and an A side of a third sheet. The processor also controls printing operations to create the B side of the second sheet and the B side of the third.

In another printing device embodiment herein the processor controls drum motion and printhead imaging for an A side image of a first sheet and the A side of a second sheet then the media path and transfix roller to transfer the images to the "A" side of a first and a second media sheet. The processor similarly controls printing operations to create the B side of the first sheet and an A side of a third sheet. Then, the processor controls printing operations to create the B side of the second sheet and the A side of a fourth sheet. The processor then controls printing operations to create the B side of the third sheet and the B side of the fourth sheet.

These and other features are described in, or are apparent from, the following detailed description.

BRIEF DESCRIPTION OF THE DRAWINGS

Various exemplary embodiments of the systems and methods are described in detail below, with reference to the attached drawing figures, in which:

FIGS. 21A-C are charts illustrating three image sequence embodiments herein.

DETAILED DESCRIPTION

Figure 1A:
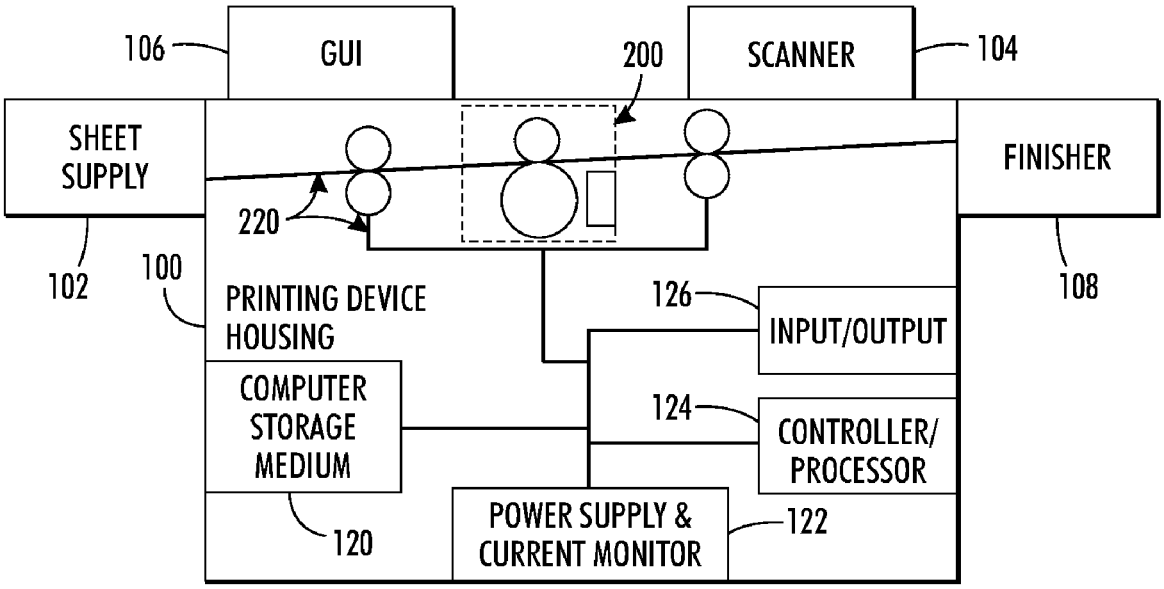
FIG. 1A is a block diagram of a printing device according to embodiments herein.

As mentioned above, one issue associated with such duplexing operations is the time delay that occurs when the sheets are passed through the duplexing path. More specifically, Letter or A4 size sheets are conventionally duplexed two at a time in a larger format printer, such as one capable of producing A3 or Tabloid size prints. Thus, in a conventional duplex print process, the A sides of two sheets are printed, the two sheets are flipped, and then the B sides of the two sheets are printed. The pair of duplex sheets is then output, and the next pair of sheets is processed for duplex printing. References to Side A and Side B of a media sheet may represent a front side and a back side, respectively, in one case and the back side and front side in another case but would be substantially consistent in either case.

The embodiments herein provide a throughput enhancement printing method for offset duplex printing that alternates media path input to a transfer nip between the first side new media sheet feed path and the flip side second image duplex media feed path so that a greater percentage of the print process timing occurs concurrently. This is facilitated by selective travel and temporary staging of one of the media sheets in the duplex path. Staging may involve momentarily being stationary but in the present process, throughput benefits by maximizing continuous motion throughout the staging region. This print process sequence minimizes delays inherent in a duplex media route that otherwise takes longer to complete than prepping and jetting subsequent images.

The embodiments herein provide significant throughput benefits to printing products having a drum or image receiving surface with sufficient length to accommodate at least two simultaneous discrete images for multiple duplex pages where the media path flips orientation for second side duplex imaging. The concept is applicable to printers of any size, with broadest benefit to models targeting high value business applications using more common media sizes and a fast print speed with multiple image duplex print jobs. Multiple images on the drum at one time provides the greatest throughput benefit from this approach, but duplexing even with multiple sheet single drum images, as with tabloid media sizes, may see gains.

Faster print speed, otherwise described as increased throughput, is one aspect of the present embodiments. Another desirable feature is that page output has a more even cadence, as occurs with simplex printing, so it is more conventional to the operator.

Some image processing times occur in a tight sequential or somewhat overlapping process that includes operation overlap. Note that not all functions involved in printing operations are referenced in the interest of simplicity. For the purposes of the embodiments herein, the most applicable functions are mentioned. Since the duplex media path includes portions of the simplex media path, such as the region through the paper pre-heater, media staging ahead of the nip for subsequent sheets may be impacted by the duplex process.

In conventional sequential imaging, the drum is prepped by wiping the image receiving surface and applying a film of release agent, referred to as a drum maintenance or DM operation. Next, image 1 and 3 are jetted onto the drum. In conventional imaging, odd numbers represent "A" side images and even numbers represent "B" side images. Sheet 1 is picked and staged, Sheet 2 is picked, then both first side media sheets are routed through the transfer nip.

In the first transfer rotation of the drum, image 1 is transferred to Sheet 1, side A, and image 3 is transferred to Sheet 2, side A. Sheet 1 is then routed into the duplex media path, and Sheet 2 progresses beyond the drum behind Sheet 1 into the duplex media path.

During subsequent preparation rotation(s) of the drum, release agent is applied to the drum, image 2 (Sheet 1, side B) and image 4 (Sheet 2, side B) are jetted onto the drum, and Sheet 1 is moved to positioned for side B transfer, and Sheet 2 follows behind. Thus, both second side media sheets are routed through the transfer nip. Imaging, in the exemplary product, requires less time than routing media through the full duplex path so even though the imaging operation partially overlaps with media movement in the duplex path, the imaging verses media travel timing is not balanced and a wait time is unavoidable.

In the second transfer rotation of the drum, image 2 is transferred to Sheet 1, side B and image 4 is transferred to Sheet 2, side B. Then, both sheets progress through the media path exit, and Sheets 1 and 2 are output.

For each additional pair of sheets, the above cycle is repeated, and the next image pair exit is delayed as the process continues. Thus, in this conventional process, the duplex pair exit adjacent one another, then the progress appears to "pause" while imaging and media staging of the first side of the next pair occurs, resulting in an uneven audible and visual cadence.

In order to reduce the delay of the foregoing process, the embodiments herein provide a throughput enhanced alternate imaging process. In one example alternate image process, the drum is first prepped, image 1 and 3 are jetted onto the drum, Sheet 1 is picked and staged, Sheet 2 is picked, and both first side media sheets are ready for routing through the transfer nip. Note that although the offset image receiving surface is referred to as a drum, other printer embodiments may use alternatives that accommodate this enhanced duplex imaging process, for example, a continuous loop band that travels linearly through an imaging or transfer region. The duplex print imaging process described in the paragraphs that follow are summarized in the Enhanced Throughput sequence of FIG. 19. The image order and sheet side described is one example of an imaging sequence but it is to be understood that there may be many variations, for example, reversing front and back side image order and the first to last page, depending on desired output order and orientation. The image order referenced herein assigns images 1 and 2 to Sheet 1, images 3 and 4 to Sheet 2 and so on.

In the first transfer rotation of the drum with embodiments herein, image 1 is transferred to Sheet 1, side A, and image 3 is transferred to Sheet 2, side A. Sheet 1 is then routed into the duplex media path, and Sheet 2 progresses behind Sheet 1 into the duplex media path. Next, image 2 (Sheet 1, side B) and image 5 (Sheet 3, side A) are jetted onto the drum. Sheet 1, side B is transferred then moves to the output while Sheet 3, image 5 is transferred. Sheet 3 then progresses into the stage area of the duplex path. It can be seen that after the first two images, which are transferred to two picked media sheets following one another, each successive duplex transfer occurs to a media sheet progressing from the duplex stage path and each first side image transfer is applied to a "new" sheet picked and progressing from a media supply. It is to be understood that an image receiving surface or drum maintenance operation is typically, though not necessarily, preformed prior to each imaging cycle and that the DM operation may wipe or clean the drum surface and/or apply a film of release agent. For convenience, this operation has not been repeatedly included in this sequence description. Also, the progress or movement of staged sheets and new sheet pick and placement is not elaborated on. The purpose of this sequence description is to provide an alternate image order example.

Continuing with the sequence, images 4 and 7 are jetted for Sheet 2, side B and Sheet 4, Side A. The images are then transferred in one drum revolution with Sheet 2, being output followed by routing Sheet 4 into the duplex media path following sheet 3. In one imaging cycle, image 6 is created for Sheet 3, side B and image 9 is created for Sheet 5, side A. Sheet 3 is transferred and output and Sheet 5 is routed into the stage area of the duplex path, now behind Sheet 4.

This operation sequence continues for the remaining duplex prints in the current job. In this example, sheet 5 is the final page so final images 8 and 10 are jetted for Side B of both page 4 and 5. These images are transferred and output to complete the job. Each complete transfer cycle of the two images on the drum consist of a first transfix cycle for the leading image and a second transfix cycle for the following image, both transfix cycles occur in rapid succession within one drum rotation. With other reduced size image and media sizes, it is possible to create a sequence that process more than two images on the drum at one time. Also, smaller images can be created in a similar fashion on a smaller printer that is incapable of accommodating two simultaneous letter or A4 images.

Therefore, with embodiments herein, the sheets are output in a conventional ordered printed sheet sequence, but imaging order is modified to accommodate the staggered routing to the transfer nip from the main and duplex paths. This technique enables a much more balanced time interval between operations so that there is less "wait" time. The result is increased throughput and a uniform output cadence. Staging a sheet in the duplex path shortens the distance of travel required by the sheet between transfer cycles, and is thus accomplished within the drum imaging time period. Product architecture with associated media path lengths influence the throughput gains that can be achieved. Another advantage of this concept is that it optionally enables a lower media velocity with associated noise and motor/power supply cost reductions.

Referring now to the drawings, as shown in FIG. 1A, the printing apparatus 100 includes a controller/processor 124 operatively connected to (directly or indirectly) the various printing components and paper path drive rollers. Further, a power supply 122 is also operatively connected to the components. The embodiments herein may pertain to any form of printing apparatus, such as the printing apparatus 100 shown in FIGS. 1A and 1B, which can comprise, for example, a printer, copier, multi-function or all-in-one machine. Any of these may now referred to as a printer for convenience.

Figure 1B:
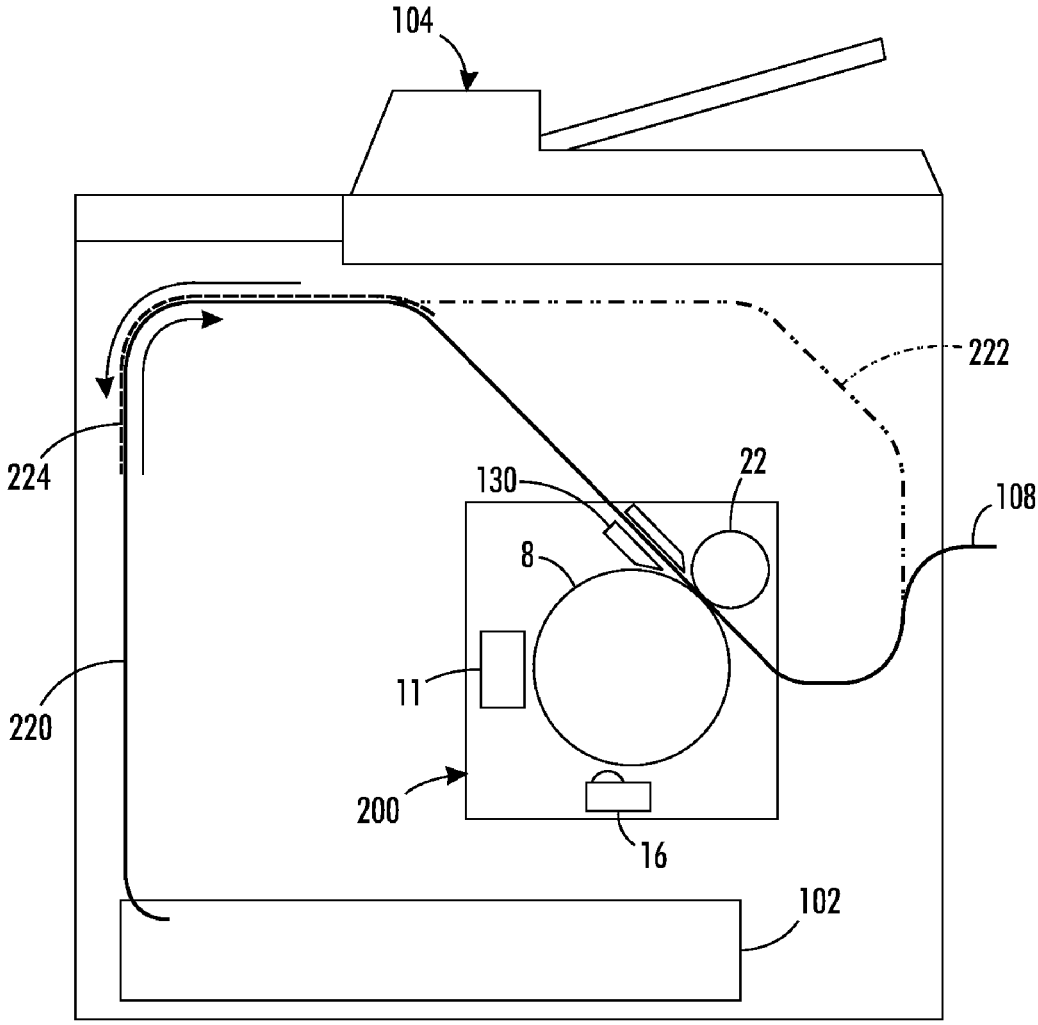
FIG. 1B is a schematic diagram of a printing device according to embodiments herein.

As would be understood by those ordinarily skilled in the art, printer systems shown in FIGS. 1A and 1B is only one example and the embodiments herein are equally applicable to other types of printing devices that may include more or fewer components. For example, those ordinarily skilled in the art would understand that additional paper paths, media trays, output options and other components or systems could be included with any printing device used with embodiments herein.

FIG. 1A illustrates subsystems associated with a printer 100 such as a user interface assembly 106 and a print engine 200 consisting minimally of an image creating device (printhead), drum, and transfix roller. Further, the printer 100 may include additional subsystems or optional devices (such as a scanner/document handler 104, finisher 108, etc.).

In the printer block diagram, shown in FIG. 1A, sheets of media are supplied from a media tray or sheet supply 102 along a paper path 220 to the print engine 200. After receiving images from the print engine 200, the sheets of media are output or pass to a finisher 108 which can fold, staple, sort, etc. An input/output device 126 is used for communications to and from the printer 100. The processor 124 controls the various actions of the printer. A computer storage medium 120 (which can be optical, magnetic, etc.) is readable by the processor 124 and stores instructions that the processor 124 executes to allow the printer to perform its various functions, such as those described above.

FIG. 1B is a more detailed illustration of the print engine 200, and paper path 220 and includes the full duplex media path with direction reversal in a portion of the simplex path. This allows inverting sheets for second side imaging. Note that a paper preheater 130 is included in this path. This level of detail is omitted in subsequent media path representations, starting with FIG. 2, which are simplified diagrams representing the imaging sequence. FIG. 1B approximately represents the applicable form and major subsystems of an actual product and shows a duplex reversal path internal to the product that is compliant with output trays or mechanisms. Other printer configurations are possible.

Figure 2:
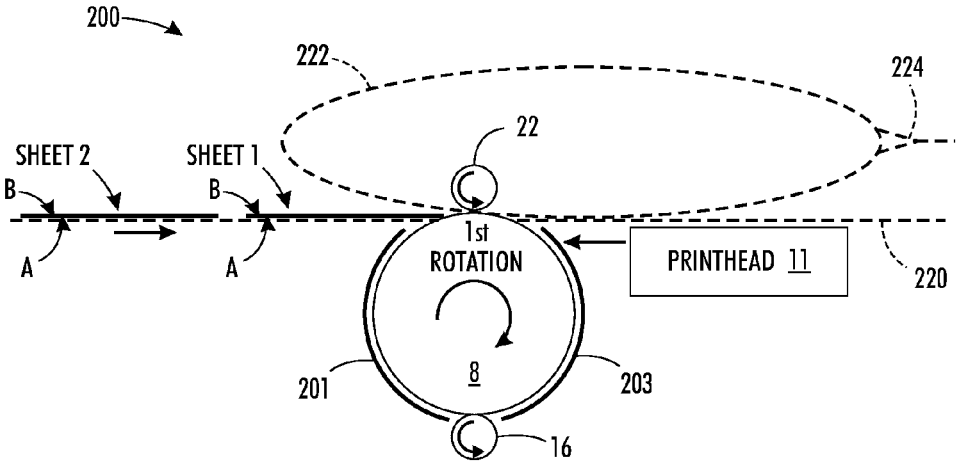
FIG. 2 is a schematic diagram of a printing device according to embodiments herein.

FIG. 2 illustrates a simplification of the printer 100 that includes a release surface on a drum 8 positioned to receive the media sheets from the (main) paper path 220, a simplified duplex paper path 222, a transfer (transfix) roller 22 positioned to transfer a jetted image to media, and a drum maintenance unit. FIG. 2 and similar successive illustrations are simplified representations with omitted systems and paper path portions and are intended only to serve as aids in visualizing the present enhanced alternating duplex imaging method. Media sheets are frequently shown spaced apart with greater than actual distances to emphasize routing. During actual transfer, sheets pass through the nip in close proximity since images on the release surface may nearly abut one another.

In this example, the duplex path 222 is illustrated as including a reversing zone 224 which the sheets enter, reverse direction, and return to the duplex path 222 in an inverted orientation. Those ordinarily skilled in the art would understand that many different types of duplex paths can be utilized and the present embodiments are not limited to the exemplary duplex path 222/224 illustrated, but instead any type of duplex path could be utilized with the present embodiments. The operation of these and additional various devices is discussed in greater detail below.

In the example shown in FIG. 2, the print engine 200 includes the paper path for duplex printing and shows the transfer nip where the drum 8 and a transfer roller 22 meet. Sheets of media that receive a second side image are flipped in the duplex loop 222 and return on the path leading to the transfer nip. The processor 124, mentioned above, is operatively connected to (directly or indirectly) the paper path 220, and duplex path 222.

Figure 3:
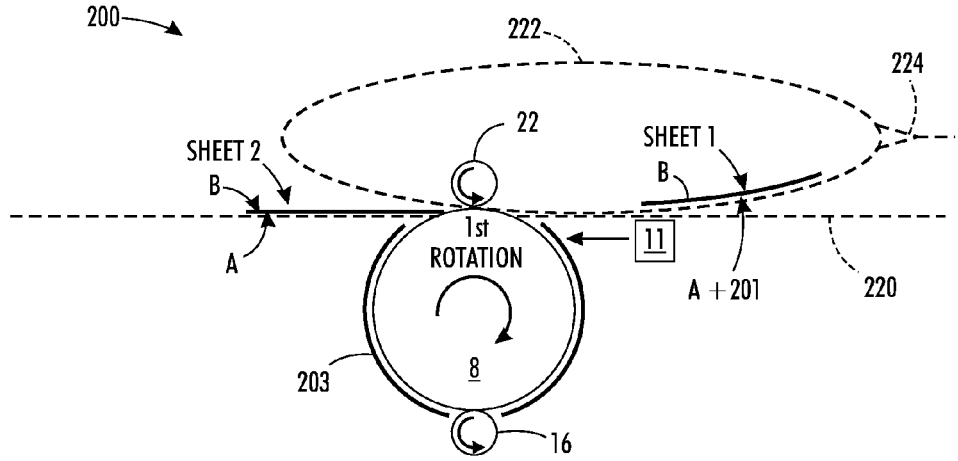
FIG. 3 is a schematic diagram of a printing device according to embodiments herein.

FIGS. 2 and 3 show several print engine systems that are controlled by the processor 124, including the drum maintenance unit 16 and print head 11. The printhead jets images 201 in preparation for transfer to media sheet. FIG. 2 shows two images 201 and 203 that will be transferred to side A of Sheet 1 and Sheet 2 during one drum 8 rotation. FIG. 3 shows Sheet 1 with transferred image being routed into the duplex path 222 and Sheet 2 and image 203 converging at the nip for transfer.

FIG. 2 illustrates the printing apparatus at the point in the printing cycle just before transfer begins. At this point in the printing operation, a drum maintenance (DM) cycle has already been performed. During the DM cycle, a film of release agent is applied to the drum release surface. The operations of jetting an image and the DM cycle may at least partially overlap. In an exemplary printer, imaging may require multiple revolutions of the drum while the DM cycle may be completed in approximately one revolution. Following the image sequence descriptions given above, the first image 201 to be applied to Side A of Sheet 1 is jetted concurrently with the "second" image 203 to be jetted, though this image 203 will be the third upon exit (Side A of Sheet 2) so it is described here as image 3.

FIG. 3 illustrates the same printer as shown in FIG. 2 at the point just before the $2^{nd}$-image 203 is transferred to Sheet 2. At this stage, Sheet 1 has passed through the transfer nip and has, therefore, received image 201. The drawings indicate that side A of Sheet 1 includes the image 201 through the indicator (A+201). The remaining drawings similarly indicate the image being present on the sides of various sheets using the same identification nomenclature. Therefore, FIG. 4 illustrates that both Sheet 1 and Sheet 2 have received their A side images (A+201 and A+203).

Release agent may be applied to the drum with a DM cycle inserted between each imaging job or at some other frequency. The DM unit may additionally or alternatively be used as a cleaning step to prepare the drum surface for imaging. In the exemplary printer, images are applied to the drum by jetting solid ink in a liquefied state from the printhead 11 as the drum rotates. Applying the image onto the surface of the drum 8 may take multiple rotations of the drum, depending upon the resolution and content of the image being applied. Therefore, there may be many rotations of the drum between the processing progression shown in the duplex cycle Figures. It is to be understood that printer states showing the progression of the present duplex printing process emphasize image and media positions, thus the imaging step and any required DM cycle that has occurred prior to attain the illustrated printer states need not be further described. Likewise, engagement of the transfix roller 22 to form a nip occurs only as the images are transferred to media and need not be repetitively mentioned. During imaging and other operational states, the transfix roller 22 is spaced apart from the drum.

Figure 4:
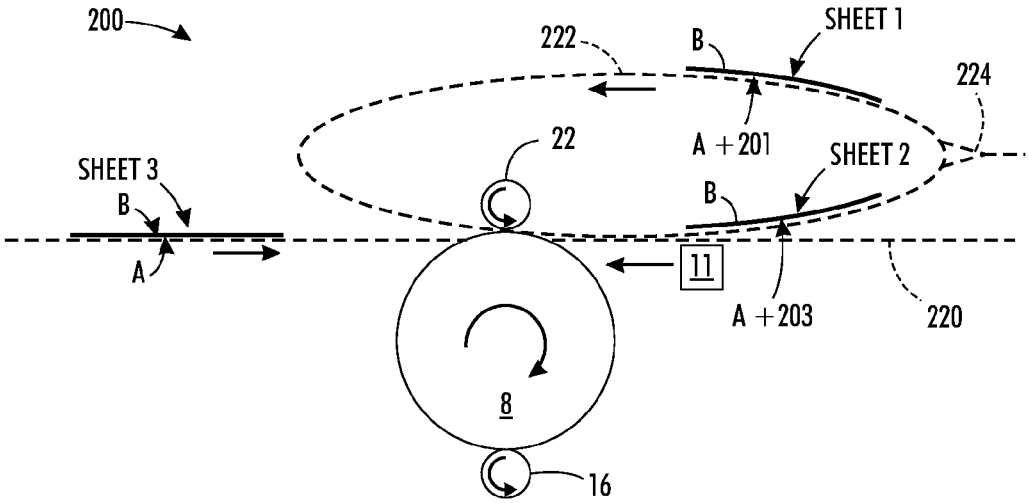
FIG. 4 is a schematic diagram of a printing device according to embodiments herein.
Figure 5:
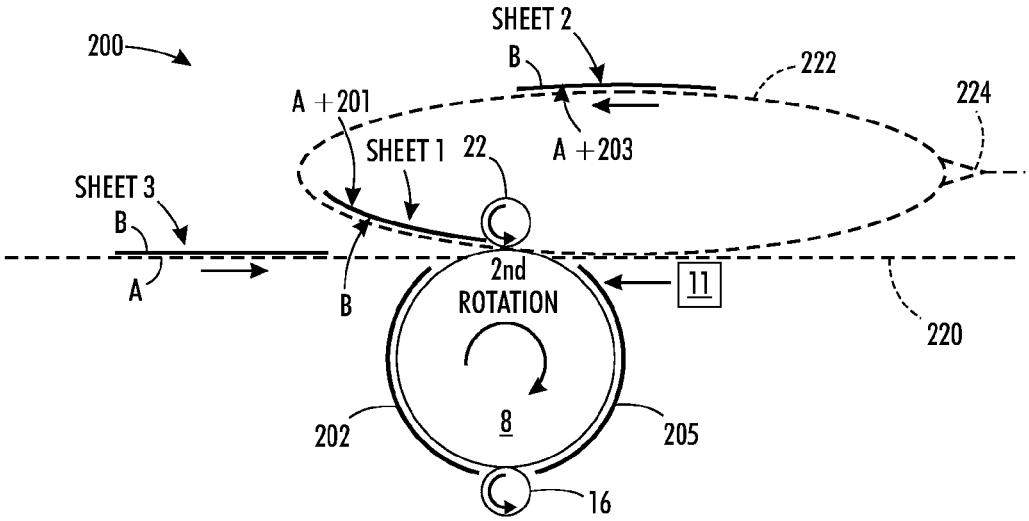
FIG. 5 is a schematic diagram of a printing device according to embodiments herein.

FIG. 4 shows Sheet 1 with image side flipped, having been routed through the reversing zone 224. Sheet 2 is shown in front of the reversing zone 224 so the image receiving side is still facing the drum side of the media path. Image 202 is the printed image of the print job that will be transferred to the B side of Sheet 1 of the duplex print cycle shown in FIG. 5. Image 205 is the fifth printed image of the print job that will appear on the A side of Sheet 3 of the duplex print job. Thus, the processor 124 alternates data for images 205 and 202 as the printhead forms these images on the drum. Note that, as shown in the drawings, both Sheets 1 and 2 are progressing through the duplex path during the imaging cycle.

Figure 6:
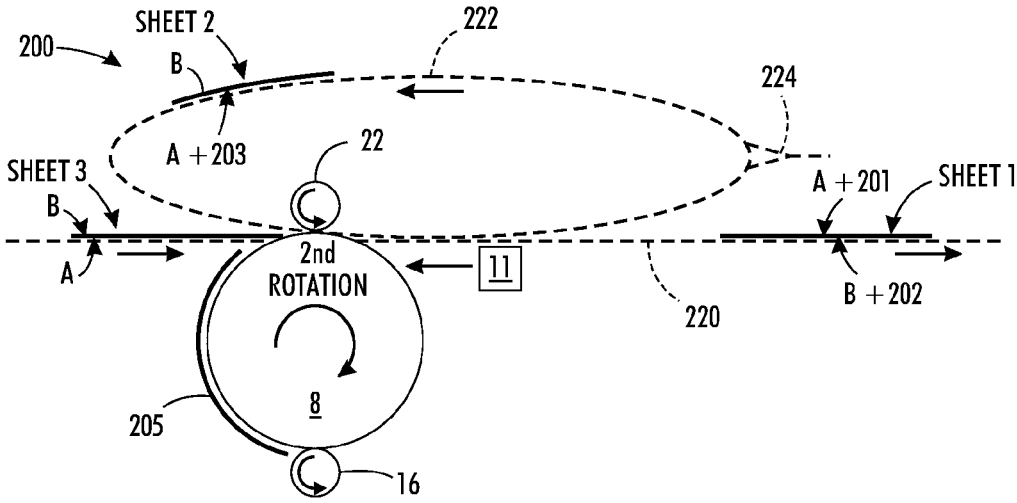
FIG. 6 is a schematic diagram of a printing device according to embodiments herein.

FIG. 6 shows Sheet 1 on the media path toward an output while Sheet 2 is traveling in the duplex stage region. Concurrent with Sheet 1 travel toward the exit, Sheet 3 is approaching the nip to receive first side image 205. Since a portion of the media path is shared by the duplex sheet and new media sheets traveling toward the nip (a non imaged sheet may be termed a "simplex" sheet), progress of a duplex sheet in the stage path may reach a position where motion is suspended until the simplex sheet passes.

Figure 7:
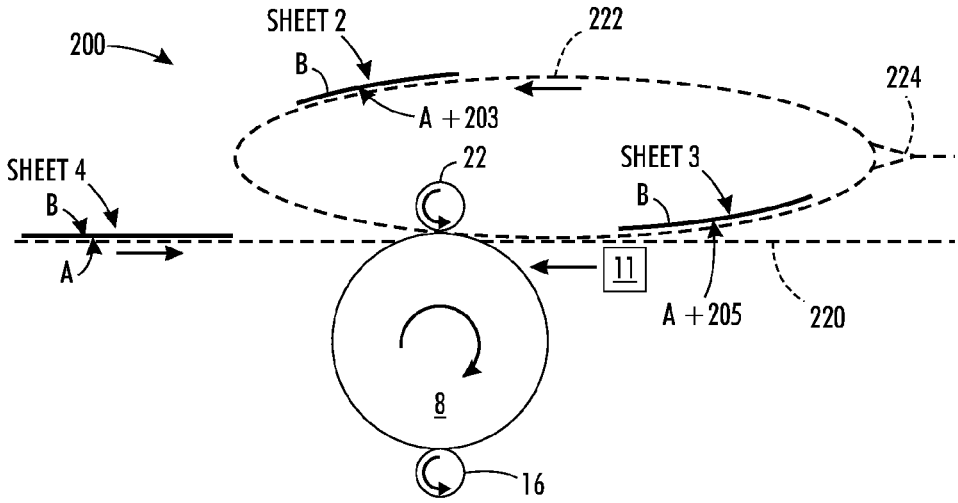
FIG. 7 is a schematic diagram of a printing device according to embodiments herein.

FIG. 7 illustrates that Sheet 3 has received the A side image (A+205) and that both Sheets 2 and 3 are progressing within the duplex path 222, 224 during the DM and imaging cycles. At least partial images would be on the drum at this point but are not depicted. Note that, as shown in the drawings, Sheet 2 was traveling inside the duplex path while Sheet 1 side B and Sheet 3 side A were being transferred in FIGS. 5 and 6. These sheets continue traveling in the duplex during imaging.

Figure 8:
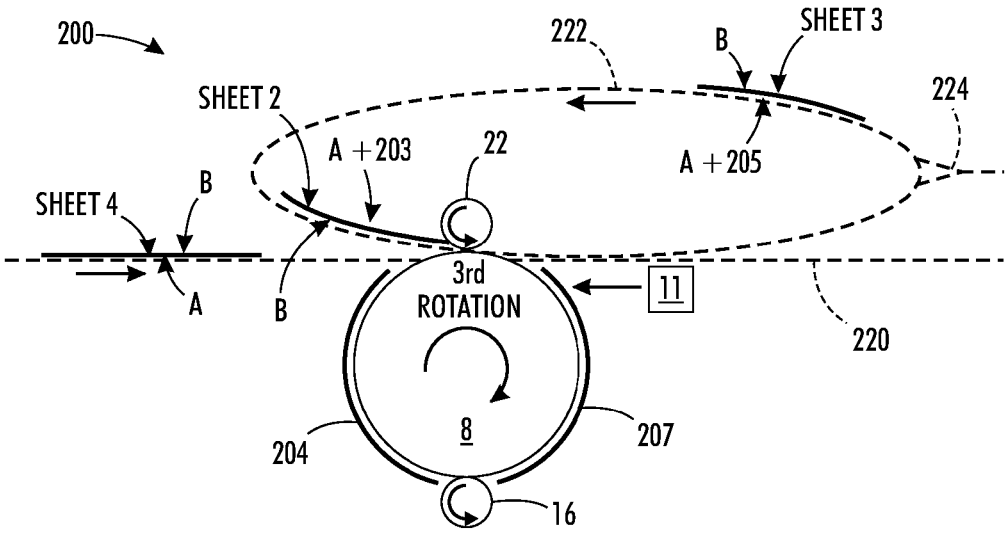
FIG. 8 is a schematic diagram of a printing device according to embodiments herein.
Figure 9:
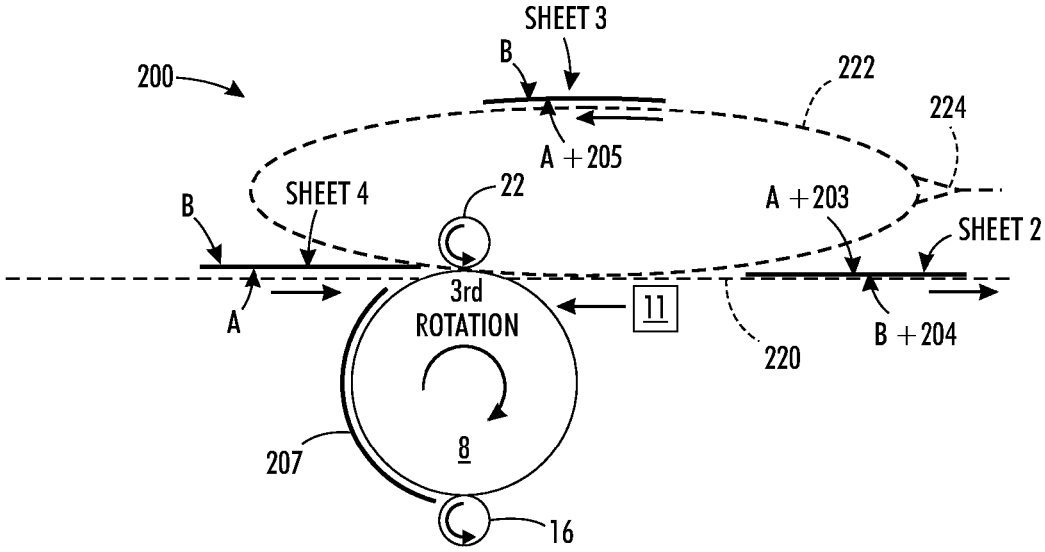
FIG. 9 is a schematic diagram of a printing device according to embodiments herein.

During each cycle or sequence such as leading up to and including the $3^{rd}$ drum transfer rotation of FIGS. 8 and 9, the processor 124 controls print operations and phasing, including the DM cycle, printhead imaging, media path drive rollers and transfix roller 22 engagement.

Figure 10:
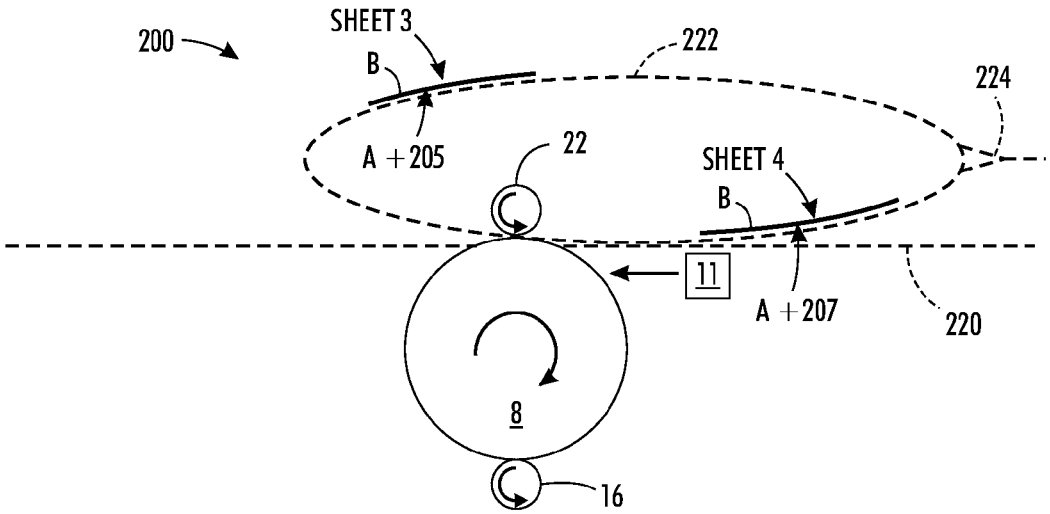
FIG. 10 is a schematic diagram of a printing device according to embodiments herein.
Figure 11:
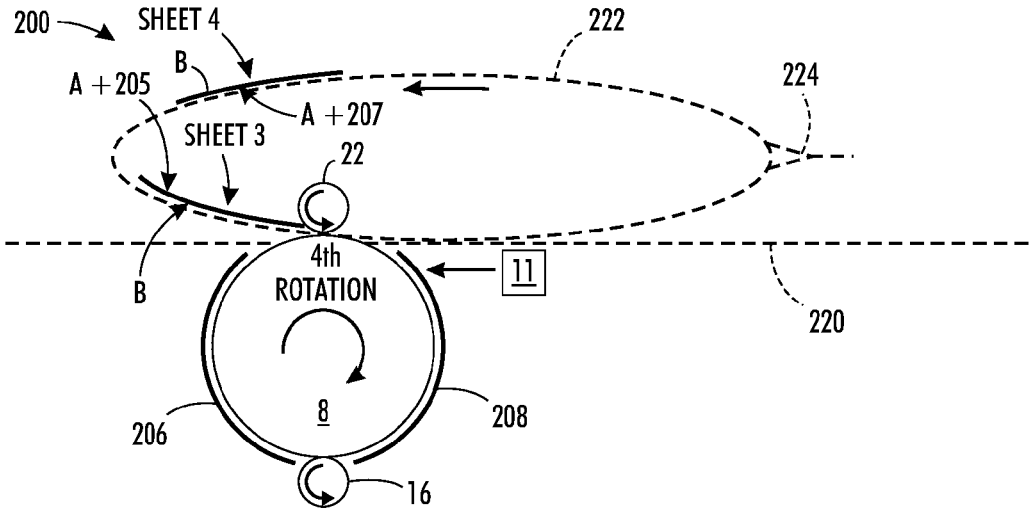
FIG. 11 is a schematic diagram of a printing device according to embodiments herein.
Figure 12:
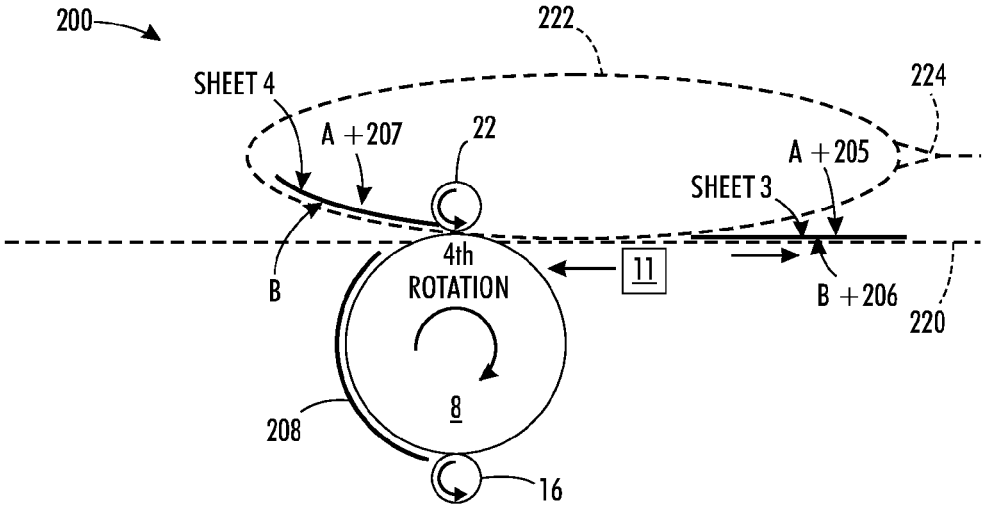
FIG. 12 is a schematic diagram of a device according to embodiments herein.
Figure 13:
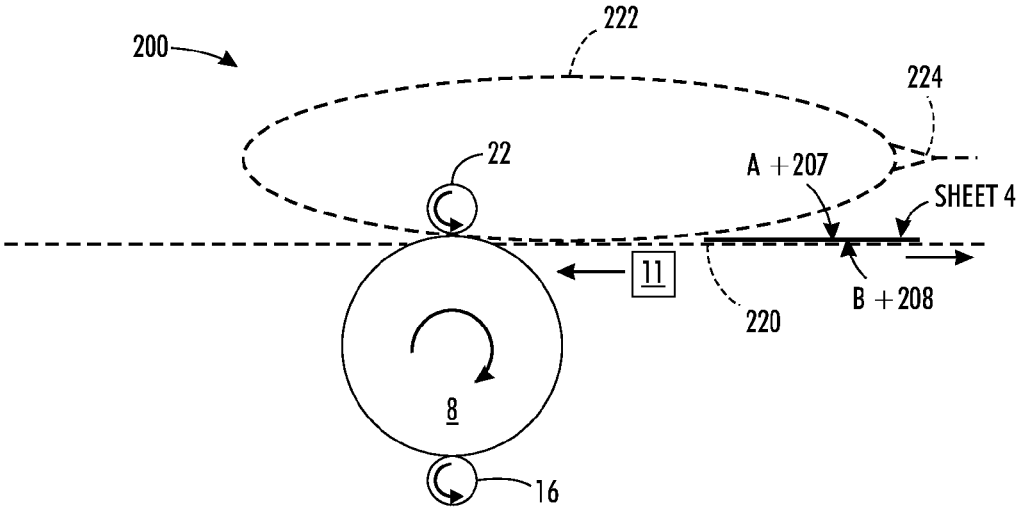
FIG. 13 is a schematic diagram of a printing device according to embodiments herein.

FIG. 10 illustrates that Sheet 4 has received the A side images (A+207) and that both Sheets 3 and 4 are progressing within the duplex path 222, 224. FIG. 10 also illustrates the phase where printhead 11 places additional images 206, 208 on the drum release surface to result in the state shown in FIG. 11. Consistent with the previously described nomenclature, image 206 is the sixth printed image in this duplex print job and will appear on the B side of Sheet 3. Image 208 is the eighth printed image in this duplex print job and will appear on the B side of Sheet 4. The processor 124 controls the phasing of the media path, drum rotation, and engagement of the transfix roller 22 to transfer image 206 on the B side of Sheet 3 followed by image 208 transfer to the B side of the fourth sheet, as shown in FIG. 12. FIG. 13 illustrates that Sheet 4 has received the B side images (A+208) and is being directed to the media output.

While a limited example of printing eight images on four duplex sheets is presented above, those ordinarily skilled in the art would understand that the number of pages and sheets is not limited. Thus, the processor 124 can direct duplex printing to continue to complete any number of print job pages.

Figure 14:
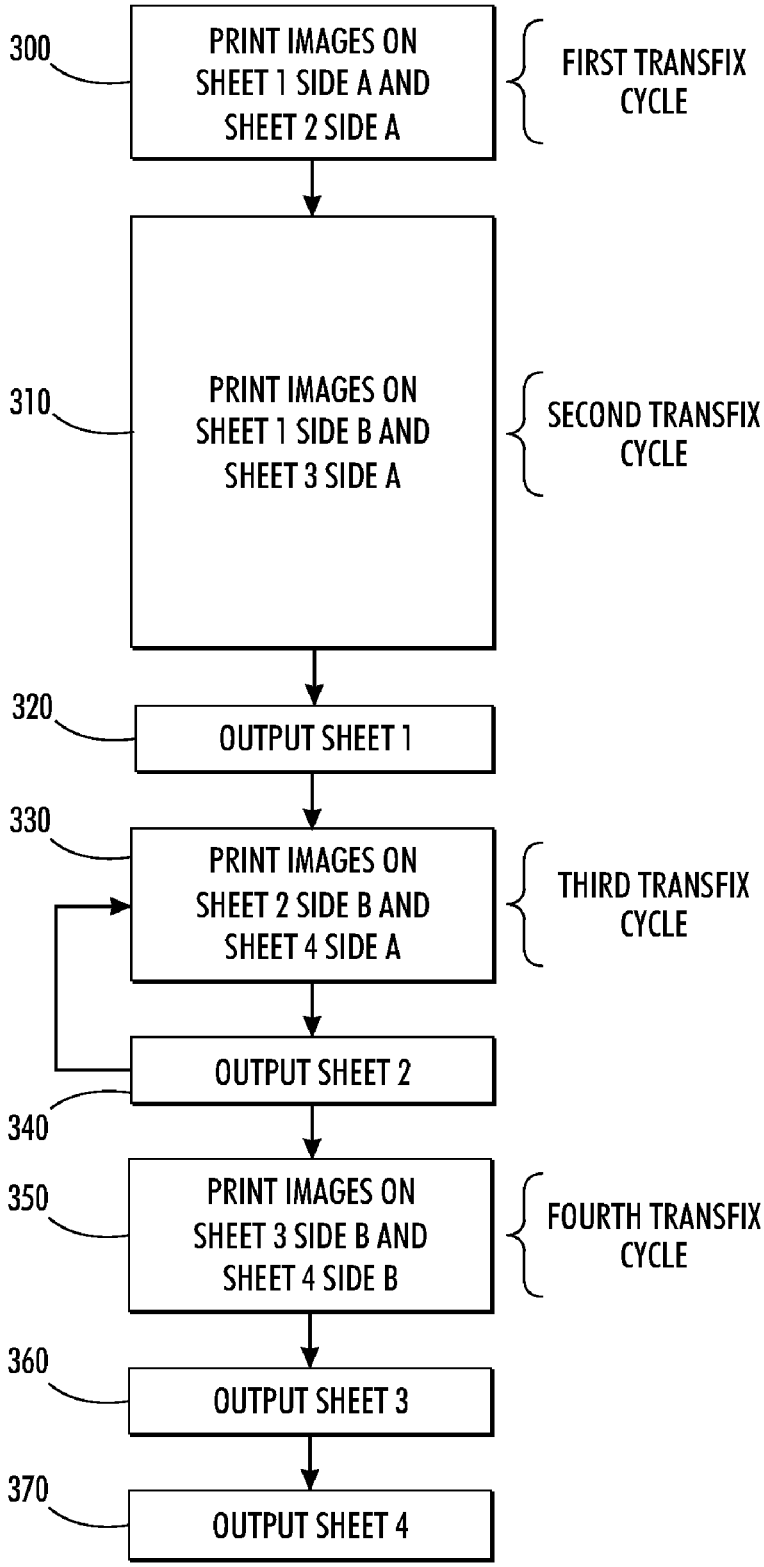
FIG. 14 is a flow diagram illustrating an embodiment herein.

This process with a 4 sheet example is shown in flowchart form in FIG. 14 where, in item 300, the method transfixes or prints an A side of a first sheet of media and an A side of a second sheet of media in a single full transfer rotation of the drum. In item 310, the method then prints the B side of the first sheet and the A side of a third sheet in a single full transfer rotation of the drum. Sheet 1 is then output in item 320.

Similarly, in item 330, the method prints the B side of the second sheet and the A side of a fourth sheet in a single full transfer rotation of the drum. In item 340, Sheet 2 is output. This method then prints the B side of the third sheet and the B side of the fourth sheet in a single full transfer rotation of the release surface in item 350. Then, in item 360, the third sheet is output and in item 370 the fourth sheet is output. For printing on more than four sheets, items 330 and 340 are repeated, as indicated by the arrow returning processing from item 340 to 330.

Figure 15:
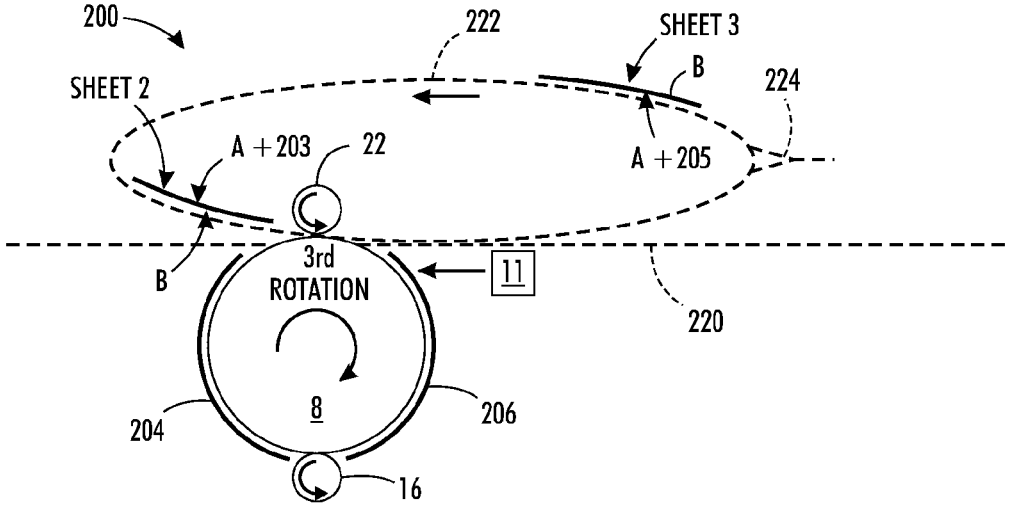
FIG. 15 is a schematic diagram of a printing device according to embodiments herein.
Figure 16:
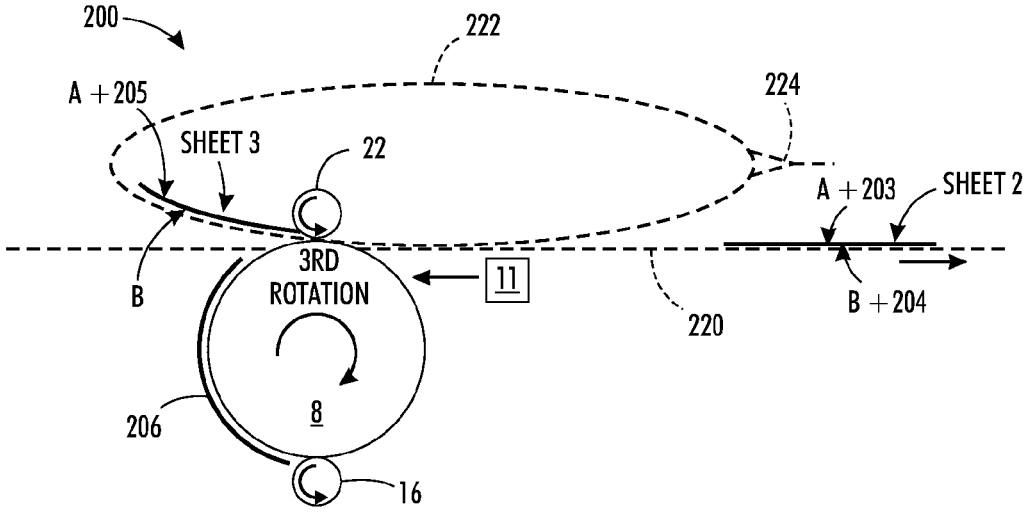
FIG. 16 is a schematic diagram of a printing device according to embodiments herein.
Figure 17:
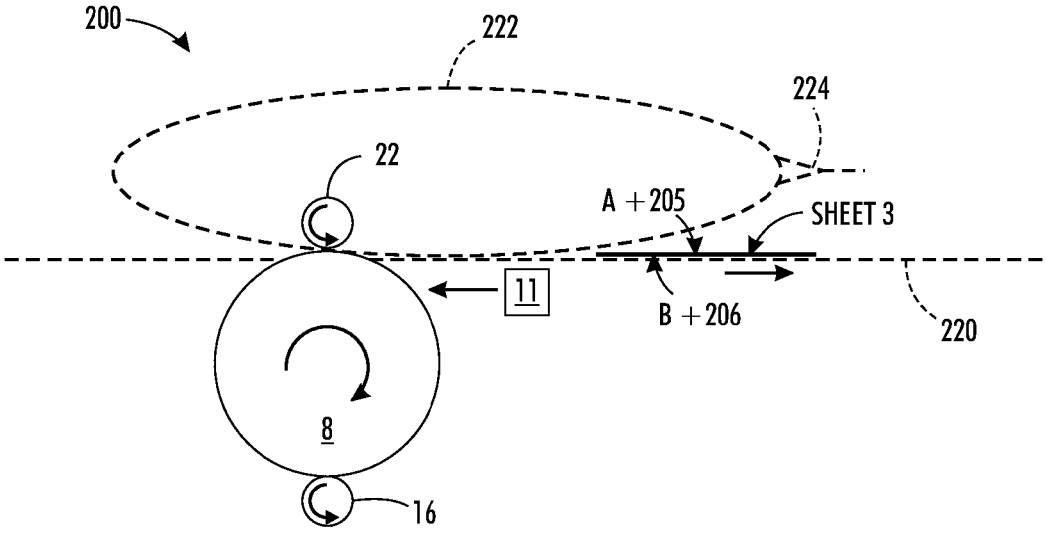
FIG. 17 is a schematic diagram of a printing device according to embodiments herein.

In another embodiment, the printer can be used to handle 3 duplexed sheets (as shown in FIGS. 15-17). This embodiment is similar to the previous embodiment up to the processing shown FIG. 8. Then, instead of performing the process shown in FIGS. 8 and 9, processing shown in FIGS. 15-17 occurs during the third transfer rotation of the drum. The processing shown in FIGS. 15-17 is substantially similar to that shown in FIGS. 8-13, except that in FIG. 15-17, Sheet 4 is not interleaved in between Sheet 2 and Sheet 3. Note that if the last sheet does not have a second side image, it will pass through as though the Side B image has no content.

Figure 18:
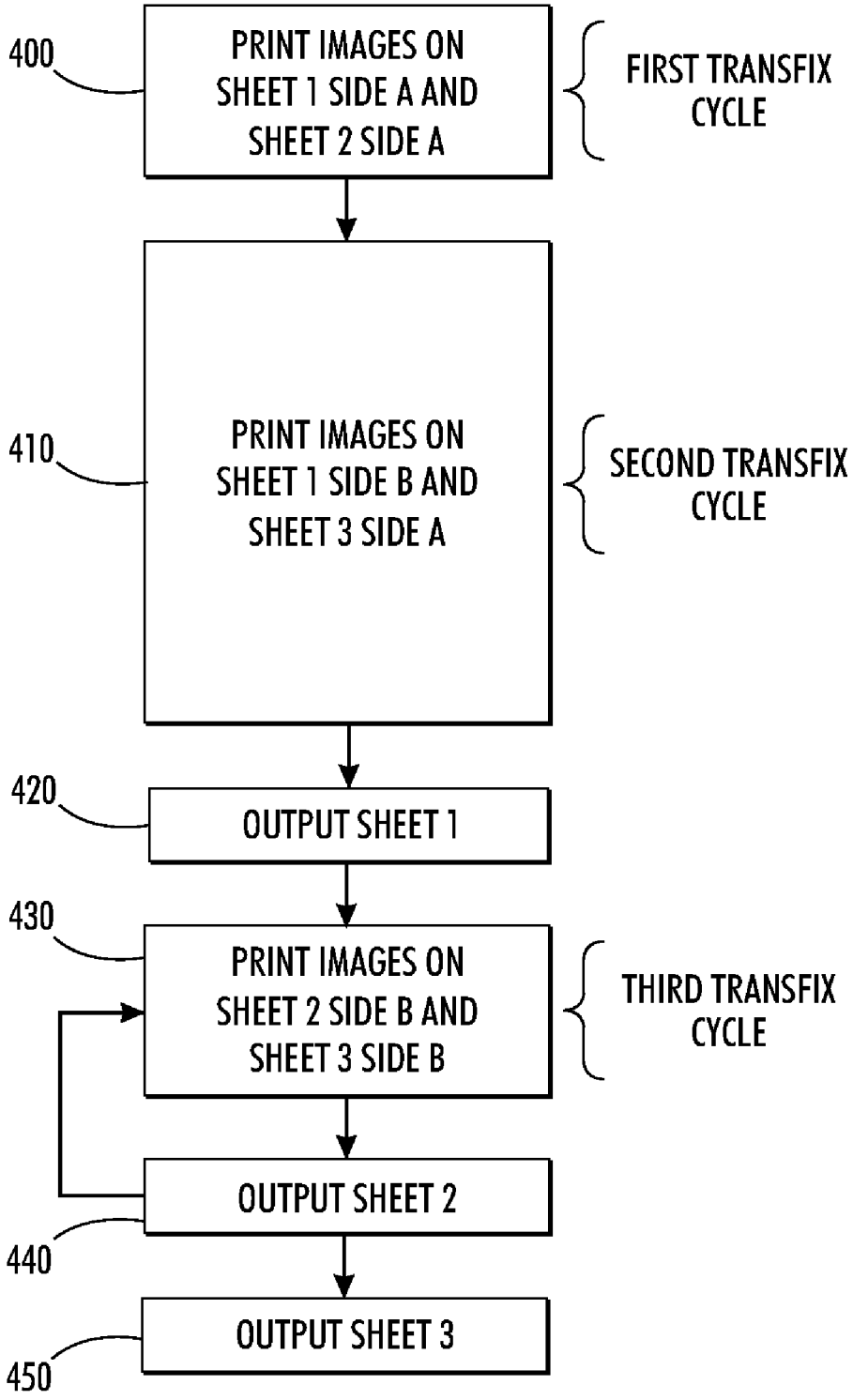
FIG. 18 is a flow diagram illustrating an embodiment herein.

This embodiment is also shown in flowchart form in FIG. 18 where, in item 400, the method prints images on an "A" side of a first sheet of media and on an "A" side of a second sheet of media in a single full transfer rotation of a drum (two-up printing). The method then prints images on the B side of the first sheet and on the A side of a third sheet in a single full transfer rotation of the release surface, shown in item 410. Sheet 1 is output in item 420. The method then prints images on the B side of the second sheet and the B side of the third sheet in a single full transfer rotation of the drum. Sheet 2 is output in item 440 and Sheet 3 is output, as in item 450.

The three sheet duplex imaging case is described because it is somewhat unique in that there is no point in the cycle that would be repeated for a greater number of sheets. The four sheet cycle would instead then be applicable as described above and illustrated in FIG. 14. The methodology of utilizing an alternate image order to improve throughput is comparable and these cases are intended to be equivalent, other than the occurrence of when in the sequence the final two sheets are processed.

Figure 19:
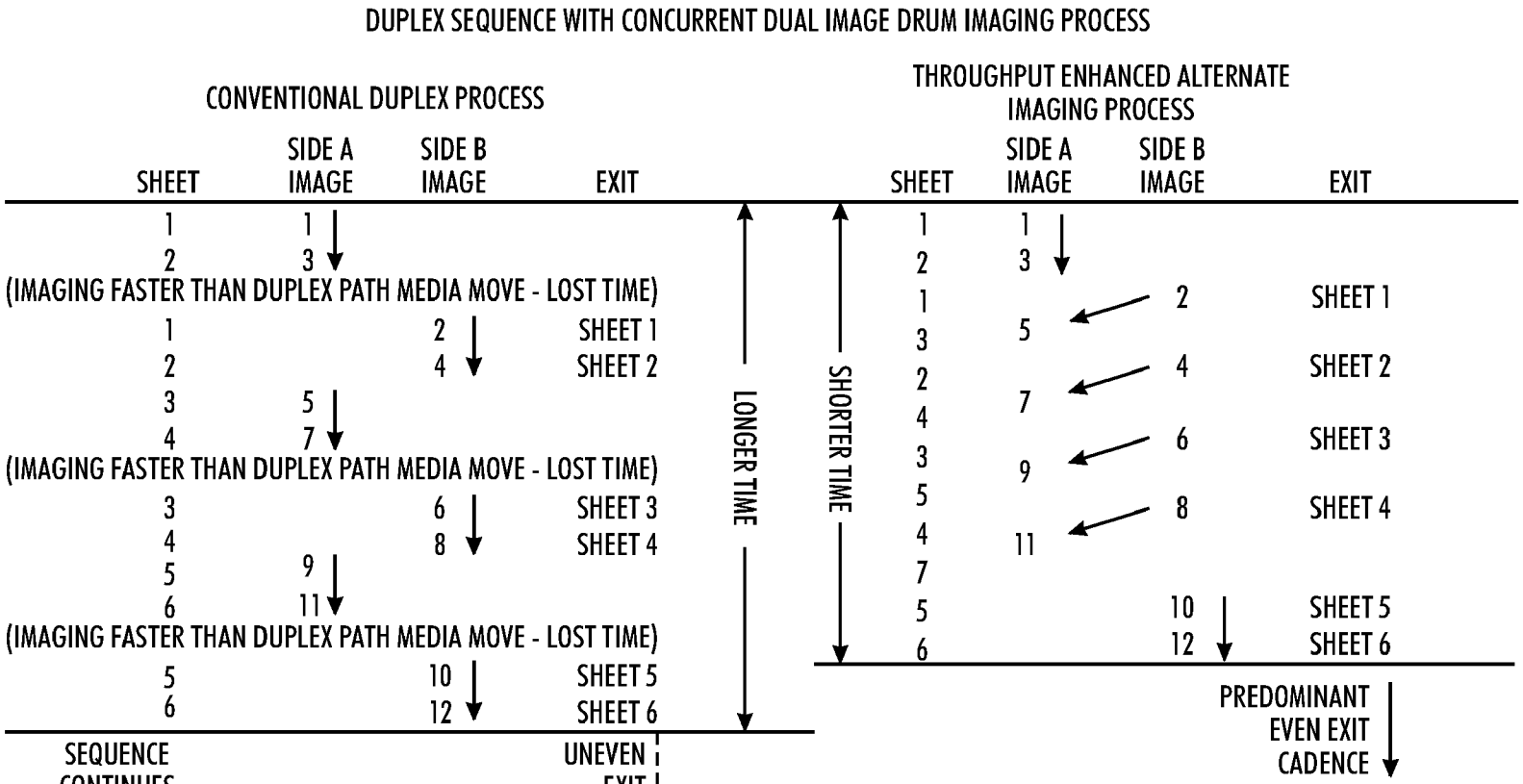
FIG. 19 is a flow diagram illustrating a conventional duplex sequence in comparison to an embodiment herein.

FIG. 19 illustrates the increased throughput benefit achieved by the embodiments herein. More specifically, in FIG. 19, the conventional process is shown on the left side of the drawing, while the process performed by embodiments herein is shown on the right side of the drawing. As can be seen on the left side of FIG. 19, there is a pause between each pair of duplex sheets, which creates a longer time delay. To the contrary, with the processing shown on the right side of FIG. 19, the sequence is continuous which results in a shorter processing time for the same duplex print job.

Figure 20:
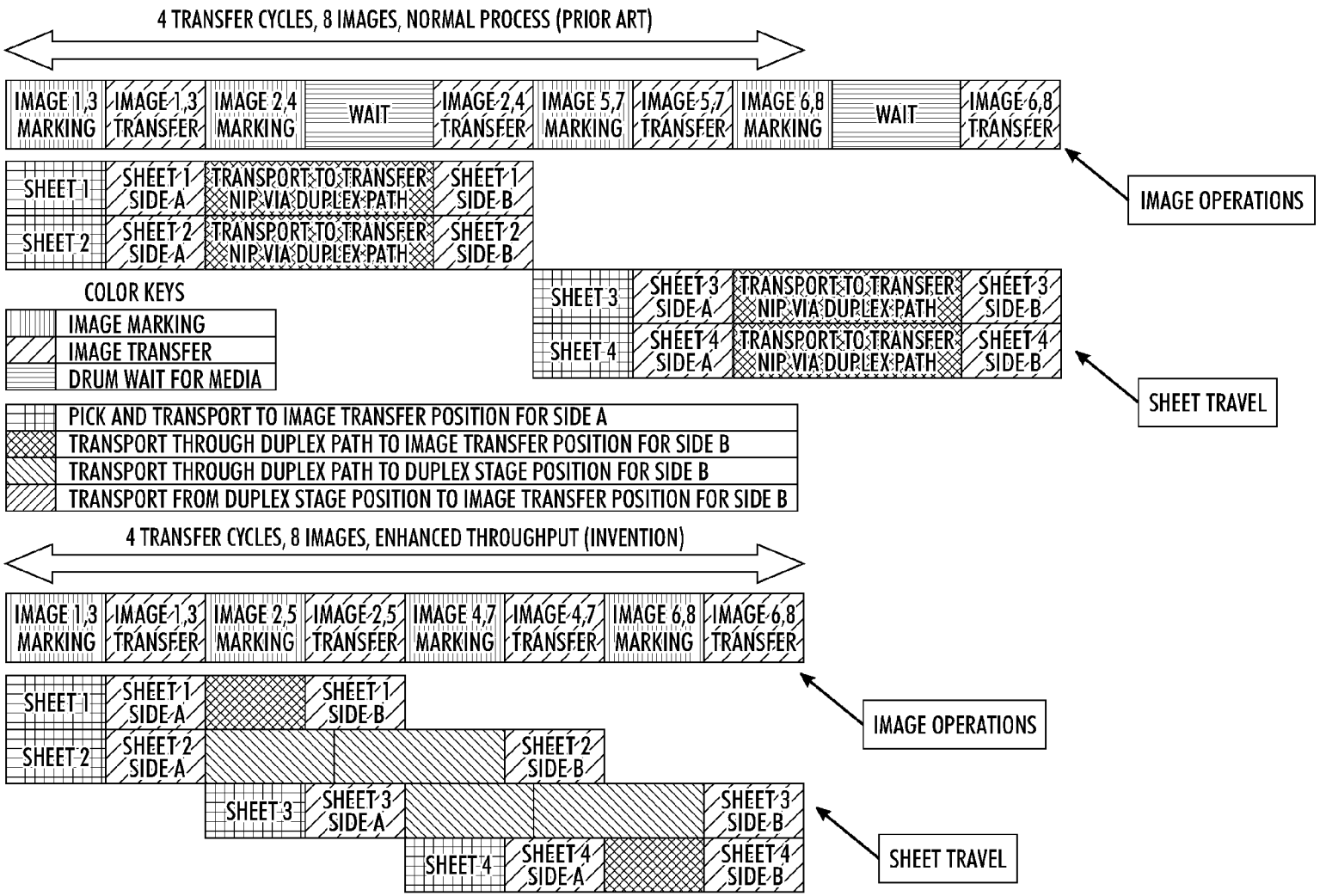
FIG. 20 is a flow diagram illustrating a conventional duplex sequence in comparison to an embodiment herein.

Similarly, in FIG. 20, the top section of the drawing illustrates a conventional processing flow, while the lower portion of the drawing illustrates the processing according to embodiments herein. Once again, with conventional processing, each cycle (which processes only two sheets at a time) contains a waiting period while the next two sheets are prepared for printing. To the contrary, as shown in the lower portion of FIG. 20, the embodiments herein provide a continuous process that avoids all or most of the waiting between pairs of sheets that are processed.

FIG. 21A shows the image sequence and image side reference for a 5 sheet example printed with the present enhanced alternate imaging process. FIG. 21B shows the sequence method for the two image pairs that are simultaneously imaged on the transfer surface as applicable to the examples previously described. FIG. 21C shows one alternate sequence example compatible with the present enhanced alternate imaging process.

The terms printer, printer product or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to printing machines and imaging technologies capable of a compatible duplex processes.

Thus, as shown above, the embodiments herein provide significant throughput benefits to printing products having a drum or other image receiving surface, which may or may not be an intermediate surface of release film, that can accommodate at least two simultaneous discrete images for multiple duplex pages where the media path flips orientation for second side duplex imaging. The term drum herein applies to any form of image receiving surface utilized in an offset printing process. The concept is applicable to printers of any size, with broadest benefit to models targeting high value business applications using more common media sizes and a fast print speed with multiple image duplex print jobs. Multiple images on the drum at one time provides the greatest throughput benefit from this approach but duplexing even with multiple sheet single drum images, as with tabloid media sizes, would see gains.

Faster print speed, otherwise described as increased throughput, is one aspect of the present embodiments. Another desirable feature is that image output has a more even cadence, as occurs with simplex printing, so it is more conventional and thus more acceptable to the operator. Yet another desirable feature is that lower paper velocities in the duplex paper path are enabled with reduced impact to throughput compared to a conventional duplex print process. Additionally, the throughput enhanced alternate imaging process allows a reduced velocity pick and stage process since only one "new" sheet is picked for each dual image pair subsequent to the first two sheets. This advantage may result in quieter operation and greater reliability.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

printing images on an A side of a first sheet of media and on an A side of a second sheet of media in a single full transfer rotation of a drum, each sheet of media has one A side and one B side;

printing images on a B side of said first sheet and an A side of a third sheet in a single full transfer rotation of said release surface; and printing images on a B side of said second sheet and a B side of said third sheet in a single full transfer rotation of said drum.

2. The method according to claim 1, further comprising performing a surface maintenance operation on said drum.

3. The method according to claim 1, further comprising, directing said sheets through a nip formed between said drum and a pressure roller when transferring said images.

4. The method according to claim 1, each of said reversing of a sheet side position comprising forwarding a corresponding sheet through a duplex paper path.

5. The method according to claim 1, the drum being an image receiving band and the drum rotation being linear travel of the band such that band surface travel is equivalent to drum circumference surface travel.

6. A method comprising:

printing images on an A side of a first sheet of media and on an A side of a second sheet of media in a single full transfer rotation of a drum, each sheet of media has one A side and one B side;

printing on a B side of said first sheet and an A side of a third sheet in a single full transfer rotation of said drum;

printing images on a B side of said second sheet and on an A side of a fourth sheet in a single full transfer rotation of said drum; and printing images on a B side of said third sheet and a B side of said fourth sheet in a single full transfer rotation of said drum.

7. The method according to claim 6, further comprising performing a surface maintenance operation on said drum.

8. The method according to claim 6, further comprising, directing said sheets through a nip formed between said drum and a pressure roller when transferring said images.

9. The method according to claim 6, each of said reversing of a sheet side position comprising forwarding a corresponding sheet through a duplex paper path.

10. The method according to claim 6, further comprising repeating said printing of said images for additional A sides and B sides of additional sheets of media.

11. A printing device comprising:

a media sheet supply that maintains media sheets to which images will be transferred;

a paper path positioned to transport said media sheets;

a drum positioned to receive said media sheets from said paper path;

a printhead positioned to apply an image by jetting ink to said drum; and a processor operatively connected to said paper path, said drum and said printhead, said processor controls said drum and said printhead to print images on an A side of a first sheet of media and on an A side of a second sheet of media in a single full transfer rotation of said drum, each sheet of media has one A side and one B side, said processor controls said drum and said printhead to print images on a B side of said first sheet and an A side of a third sheet in a single full transfer rotation of said drum, and said processor controls said drum and said printhead to print images on a B side of said second sheet and on a B side of said third sheet in a single full transfer rotation of said drum.

12. The printing device according to claim 11, further comprising performing an imaging surface preparation operation by apply a release agent to said drum.

13. The printing device according to claim 11, further comprising a pressure roller adjacent said drum and forming a nip between the pressure roller and said drum for transferring said images to said sheets.

14. The printing device according to claim 11, said paper path further comprising a duplex loop, said processor directing said sheets into said duplex loop when reversing a side position of said sheets.

15. The printing device according to claim 11, the drum being an image release band and the drum rotation being linear travel of the band such that band surface travel is equivalent to drum circumference surface travel.

16. A printing device comprising:

a media sheet supply that maintains media sheets to which marking material will be transferred;

a paper path positioned to transport said media sheets;

a drum positioned to receive said media sheets from said paper path;

an ink jet printhead positioned to transfer said marking material to said drum; and a processor operatively connected to said paper path, said drum and said printhead, said processor controls said drum and print head to print images on an A side of a first sheet of media and on an A side of a second sheet of media in a single full transfer rotation of said drum, each sheet of media has one A side and one B side, said processor controls said drum and said printhead to print images on a B side of said first sheet and an A side of a third sheet in a single full transfer rotation of said drum, said processor controls said drum and said printhead to print images on a B side of said second sheet and on an A side of a fourth sheet in a single full transfer rotation of said drum, and said processor controls said drum and said printhead to print images on a B side of said third sheet and a B side of said fourth sheet in a single full transfer rotation of said drum.

17. The printing device according to claim 16, further comprising performing a surface maintenance operation on said drum.

18. The printing device according to claim 16, further comprising a transfer roller adjacent said drum and forming a nip between the transfer roller and said drum for transferring said images to said sheets.

19. The printing device according to claim 16, said paper path further comprising a duplex loop, said processor directs said sheets into said duplex loop when reversing a side position of said sheets.

20. The printing device according to claim 16, said processor repeating said printing of said images for additional A sides and B sides of additional sheets of media.

* * * * *